United States Patent [19]

Wiesner

[11] 4,143,302

[45] Mar. 6, 1979

[54] ENERGIZING CIRCUIT FOR A FLUORESCENT LAMP

[75] Inventor: Ernst Wiesner, Dornbirn, Austria

[73] Assignee: Zumtobel Aktiengesellschaft, Dornbirn, Austria

[21] Appl. No.: 792,215

[22] Filed: Apr. 29, 1977

[30] Foreign Application Priority Data

Apr. 30, 1976 [AT] Austria ..... 3213/76

[51] Int. Cl.[2] ..... H05B 41/16

[52] U.S. Cl. ..... 315/205; 315/101; 315/207; 315/245; 315/289; 315/DIG. 5

[58] Field of Search ..... 315/94, 98, 101, 105, 315/200 R, 205, 207, 245, 306, DIG. 2, DIG. 5, 246, 265, 266, 283, 289, DIG. 4

[56] References Cited

U.S. PATENT DOCUMENTS

| | | | |
|---|---|---|---|
| 3,643,127 | 2/1972 | Laupman | 315/205 X |
| 3,705,329 | 12/1972 | Vogeli | 315/207 X |
| 3,890,539 | 6/1975 | Remery | 315/283 X |

*Primary Examiner*—Eugene R. LaRoche
*Attorney, Agent, or Firm*—Hans Berman

[57] ABSTRACT

A fluorescent lamp fires more quickly at low temperature and its service life is lengthened if the input terminals of a full-wave rectifier are connected to the lamp electrodes and a resistor and capacitor are connected in parallel circuit between the output terminals of the rectifier. The voltage pulses applied to the electrodes prior to firing are reduced in peak amplitude and broadened by the improved circuit.

6 Claims, 3 Drawing Figures

ENERGIZING CIRCUIT FOR A FLUORESCENT LAMP

This invention relates to fluorescent lamps, and particularly to an improved energizing circuit for a fluorescent lamp of the conventional type having two filament electrodes spaced in a gas-tight envelope, the lamp being supplied with lighting current.

It has been found that the service life of such a lamp is reduced when it is operated at less than its rated wattage. The cause of the shortened useful life span has been found in the peaks of the firing potential which are particular steep when a lamp is operated at a temperature below the optimum temperature of the gas in the envelope. It has further been found that not only the magnitude of the firing voltage unfavorable affects lamp life, but also the very short time during which the firing pulse is applied in conventional lamp energizing circuits.

Abnormally low operating temperatures may be caused by properties of the lamp and its energizing circuit or by environmental conditions. Lamps equipped with continuous or stepwise brightness controls and operated below their rated output do not normally reach optimum temperatures. Low operating temperatures are also characteristic of lamps employed for lighting subterranean tunnels, refrigerated spaces, roads during the cold season or exposed to high winds, and the like.

A primary object of this invention is the provision of an energizing circuit for a fluorescent lamp in which the amplitude of firing voltage pulses is reduced and their duration is increased.

This is achieved according to the invention by connecting the two filaments or electrodes of the lamp with the input terminals of a full-wave rectifier, and the rectifier output terminals with a damping or attenuating unit, such as a capacitor and resistor in parallel circuit.

A fluorescent lamp equipped according to the invention fires more reliably at unusually low temperatures, and its useful life is lengthened by reduction of the normal operating stresses in the filaments.

Other features and many of the attendant advantages of this invention will readily be appreciated as the same becomes better understood from the following description of a preferred embodiment when considered in connection with the appended drawing in which.

Figure 1:
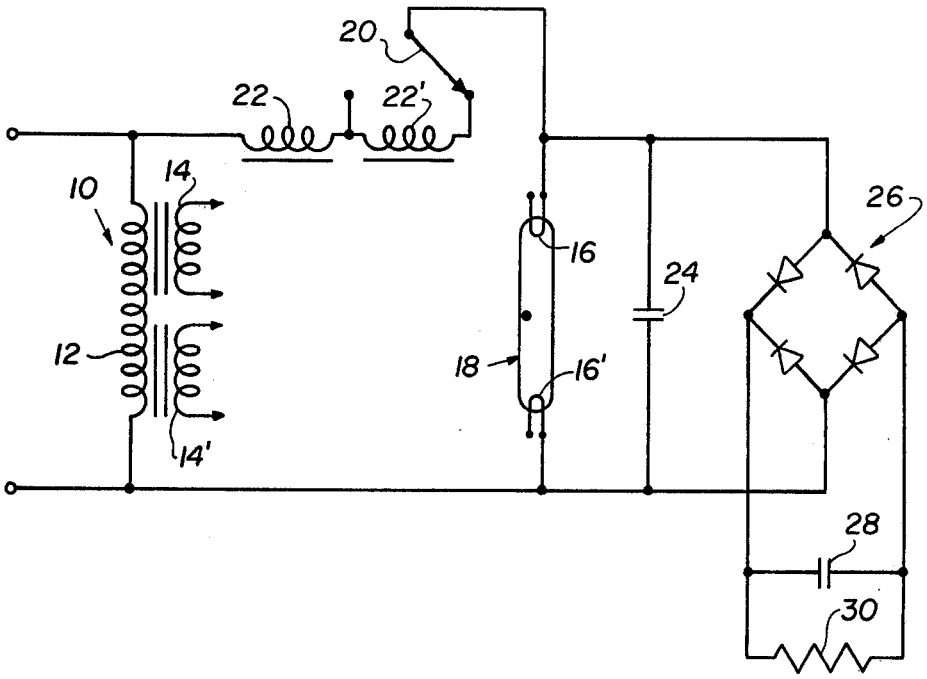
FIG. 1 is a diagram of the energizing circuit of a fluorescent lamp according to the invention.

Referring now to FIG. 1, there is shown a filament transformer 10 whose primary winding 12 is connected to an alternating current line at 110 volts, 60 cycles. The two secondary windings 14, 14' of the transformer are connected to respective filament electrodes 16, 16' spaced in the phosphor-coated glass envelope of a fluorescent lamp 18. The electrode 16 is connected to the AC line through a selector switch 20 and two series-connected inductors 22, 22' in the illustrated switch position. One inductor 22' may be taken out of the lamp circuit by the switch 20. An interference suppressing capacitor 24 is arranged in parallel with the electrodes 16, 16'. The lamp circuit described so far is conventional and too well known to require more detailed descriptions.

According to the invention, the input terminals of a bridge, full-wave rectifier 26 are conductively connected to the electrodes 16, 16', and a capacitor 28 and an resistor 30 are arranged in parallel circuit across the output terminals of the rectifier 26 as a damping or attenuating unit. The effects of the rectifier 26 and associated elements in a preferred embodiment of the invention on the firing voltage applied to the electrodes 16, 16' are evident from comparison of FIGS. 2 and 3.

In a typical energizing circuit of the invention for a lamp having rated output of 40 watts, a rectifier being able to have an output voltage of 430 volts, a capacitor 28 of 0.3 microfarad and an resistor 30 of 500 kiloohms were used.

Figure 2:
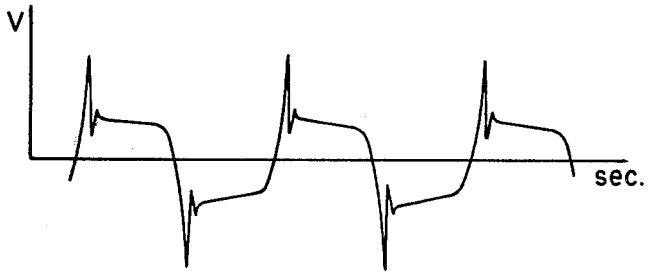
FIG. 2 shows changes in firing potential as a function of time across the electrodes of a conventional fluorescent lamp.
Figure 3:
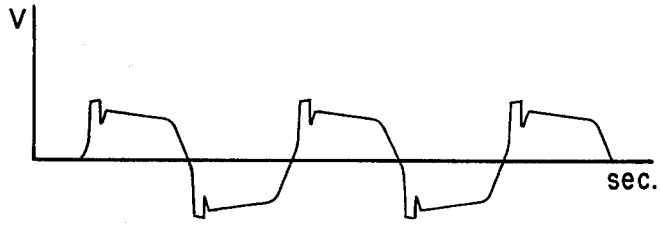
FIG. 3 illustrates analogous potential changes in a lamp equipped with the energizing circuit of the invention.

FIG. 2 shows the firing potential across the electrodes 16, 16' in the absence of the rectifier 26 as a function of time in arbitrary, but constant units. After each voltage reversal, the applied potential rises steeply to a peak which decays as rapidly as it rises. After firing, the curve assumes its normal sinusoidal shape, not shown. When the rectifier and its attenuating unit are connected across the electrodes 16, 16' under otherwise identical conditions, the potential v. time curve assumes the shape shown in FIG. 3. The firing potential reaches a peak of reduced amplitude and increased duration. The filaments 16, 16' are subjected to much reduced stresses, and their life is correspondingly lengthened. Yet, the firing characteristics of the lamp are not unfavorably affected.

The diagram of FIG. 1 shows a fluorescent lamp which may be operated without a starter. Yet, the rectifier arrangement of the invention is equally effective in lamps equipped with a starter, as is conventional in itself. A full-wave rectifier other than the illustrated and preferred bridge rectifier may be employed if so desired, and other modifications of the energizing circuit will readily suggest themselves to those skilled in the art.

It should be understood, therefore, that the foregoing disclosure relates only to a preferred embodiment of the invention, and that it is intended to cover all changes and modifications of the example of the invention herein chosen for the purpose of the disclosure which do not constitute departures from the spirit and scope of the invention set forth in the appended claims.

What is claimed is:

1. In a system having a source of AC voltage, a gas discharge lamp for emitting light substantially continuously during an operating time thereof, said gas discharge lamp having a first and a second electrode, and main energizing means for connecting said gas discharge lamp to said source of AC voltage at a starting instant, said main energizing means having a voltage spike creating means for creating a voltage spike for firing said lamp in each cycle of said AC voltage during said operating time and for a start-up time starting at said starting instant and continuing to the start of said operating time, the improvement comprising damping means connected to said main energizing means for decreasing the amplitude and increasing the duration of said spike in each of said cycles during said operating time and said start-up time, thereby increasing the life of said lamp.

2. A system as set forth in claim 1 further comprising heating means connected to said first and second electrode and operative independently of said damping means for furnishing a heating current to said first and second electrodes.

3. A system as set forth in claim 2, wherein said damping means include a full-wave rectifier having a first input terminal directly connected to said first electrode, a second input terminal directly connected to said second electrode, and a first and a second output terminal, and an RC circuit connected from said first to said second output terminal.

4. A system as set forth in claim 3, wherein said RC circuit includes a capacitor, and a resistor connected in parallel to said capacitor.

5. A system as set forth in claim 4, further comprising a noise-suppressing capacitor connected from said first to said second electrode of said gas discharge lamp.

6. A system as set forth in claim 2, wherein said heating means include a transformer having a first and a second secondary winding respectively connected to said first and second electrode for furnishing said heating current thereto.

* * * * *